US011535412B2

(12) United States Patent
Guldimann et al.

(10) Patent No.: US 11,535,412 B2
(45) Date of Patent: Dec. 27, 2022

(54) METHOD FOR UNPACKING A WORKPIECE, UNPACKING APPARATUS AND A PROCESSING APPARATUS HAVING AN UNPACKING APPARATUS OF THIS KIND

(71) Applicant: OptoTech AG, Bellach (CH)

(72) Inventors: Benito Guldimann, Luterbach (CH); Claude Volken, Balsthal (CH); Ulrich Wyler, Langenthal (CH); Stefan Anthamatten, Utzenstorf (CH); Volker Harnickell, Rüttenen (CH)

(73) Assignee: OptoTech AG, Bellach (CH)

( * ) Notice: Subject to any disclaimer, the term of this patent is extended or adjusted under 35 U.S.C. 154(b) by 0 days.

(21) Appl. No.: 17/084,860

(22) Filed: Oct. 30, 2020

(65) Prior Publication Data

US 2021/0130026 A1 May 6, 2021

(30) Foreign Application Priority Data

Nov. 6, 2019 (EP) ..... 19207375

(51) Int. Cl.
*B65B 69/00* (2006.01)

(52) U.S. Cl.
CPC ..... *B65B 69/0058* (2013.01); *B65B 69/0033* (2013.01)

(58) Field of Classification Search
CPC ..... B65B 69/0008; B65B 69/0058; B65B 69/0033
See application file for complete search history.

(56) References Cited

U.S. PATENT DOCUMENTS 3,266,541 A * 8/1966 Kluytenaar ..... B65B 69/0033 83/72
3,889,442 A * 6/1975 Grahn ..... B65B 43/38 414/412
4,843,801 A * 7/1989 Roncero ..... B65B 69/0033 53/492
5,275,523 A 1/1994 Stewart et al.
5,442,895 A * 8/1995 Linson ..... B65B 69/0008 414/412

(Continued)

FOREIGN PATENT DOCUMENTS

DE 10 2007 027878 12/2008
EP 404272 A * 12/1990 ..... B65B 69/0033

(Continued)

*Primary Examiner* — Glenn F Myers
(74) *Attorney, Agent, or Firm* — Clark & Brody LP

(57) ABSTRACT

A method for unpacking a workpiece, in particular an optical lens or an optical lens blank, from a package, includes an automated cutting open step of a first package side of the package, and an automated sliding of the workpiece out of the package step on the first package side. An unpacking apparatus for unpacking a workpiece from a package, has a feed station for receiving a package in which a workpiece is arranged, a cutting-open station having a first cutting or sawing tool for the automated cutting open of a first package side of the package downstream of the feed station, and a slide-out station downstream of the cutting-open station. A relative movement can be produced between the package and the workpiece in an automated manner so that the workpiece slides out of the package on the first package side.

24 Claims, 7 Drawing Sheets

(56) References Cited

U.S. PATENT DOCUMENTS

| | | | | |
|---|---|---|---|---|
| 6,694,852 | B1 * | 2/2004 | Ours | B65B 69/0033 414/412 |
| 2015/0314903 | A1 * | 11/2015 | Aya | B65B 69/0008 414/412 |
| 2017/0158369 | A1 * | 6/2017 | Dopfer | B65B 69/0008 |
| 2020/0047937 | A1 * | 2/2020 | Bohn | B65B 43/42 |
| 2021/0130025 | A1 * | 5/2021 | Schaafsma | B65B 59/02 |

FOREIGN PATENT DOCUMENTS

| | | |
|---|---|---|
| WO | 2007/023538 | 3/2007 |
| WO | 2017/094191 | 6/2017 |

* cited by examiner

METHOD FOR UNPACKING A WORKPIECE, UNPACKING APPARATUS AND A PROCESSING APPARATUS HAVING AN UNPACKING APPARATUS OF THIS KIND

The invention relates to a method for unpacking a workpiece in accordance with Claim 1, to an unpacking apparatus according to Claim 7 and to a processing apparatus according to Claim 15 having an apparatus of this kind.

In the processing of workpieces such as optical lenses and lens blanks, these are typically individually packed in packages before processing. In this case, the lenses to be processed, in particular spectacle glass blanks, may well have different diameters, thicknesses and surface curvatures before they are fed to processing machines. Most packages for these workpieces have a cuboidal outer covering made of cardboard. Within this covering, the workpiece can be arranged in a paper bag, a film bag or a package shell made of plastic (also referred to as a blister) or of paper. Combinations of mounting of an enveloped lens in a package shell are also known. The envelope can be placed around the workpiece like a cloth made of foamed plastic or, alternatively, of felt material, or the workplace is wrapped therein. As an alternative, the envelope can also be formed by sealing the workpiece into a closed plastic bag. Before processing can start, workpieces must currently be removed from the package by hand and placed in "job trays", when manufacturing spectacle glass usually in pairs for the subsequent spectacles. The packaging materials are separated from one another. The disadvantages with manual unpacking are the high wage costs and the great monotony of the work. Nevertheless, several tens of thousands of lenses per day are processed on larger processing lines, e.g. In spectacle glass grinding works. In principle, this also does not allow any interruption in the unpacking, and therefore employee breaks must be covered by additional personnel.

In order to transmit the properties of the workpiece to the subsequent workstations, the packages or parts thereof are often placed in the job trays as well or fixed thereon. In the process, mistakes due to human error may occur. This leads to rejects and may even damage downstream processing machines.

It is therefore the object of the Invention to eliminate sources of error during unpacking and to make this work step more cost-effective. At the same time, the solution should work continuously and reliably.

The main features of the invention are given in Claims 1, 7 and 15. Developments form the subject matter of Claims 2 to 6 and 8 to 14 and of the following description.

The Invention relates to a method for unpacking a workpiece, in particular an optical lens or an optical lens blank, from a package, comprising automated cutting open of a first package side of the package, and automated sliding of the workpiece out of the package on the first package side.

The advantage of this is that no manual work is necessary in order first of all to align the package and then open it at a location provided for this purpose. By means of automated cutting open, damage to the workpiece can be prevented, and defined opening for sliding out can be produced. Cutting open is preferably performed with a linear cut. This is easy to produce.

The method is suitable particularly for workplaces which are optical lenses or optical lens blanks. These have two opposite lens sides, of which generally at least one is of curved design. Moreover, the optical lens or the optical lens blank preferably has a round lens circumference, preferably with a lens diameter of between 40 mm and 100 mm and, as a further preference, between 50 mm and 85 mm. The workpiece can be composed of glass or transparent plastic, for example.

In principle, there is the possibility of bringing about the sliding out exclusively by means of gravity, in particular if the first package side faces obliquely or vertically downwards or is moved into such a position after the first package side has been cut open. This can be Implemented in a particularly economical way.

However, higher process reliability is achieved in one version of the method in which sliding out of the workpiece is accomplished by pushing the workpiece out on the first package side by means of a pusher, which moves Into the package on a second package side situated opposite the cut-open first package side. This avoids a situation where the workpiece becomes stuck due to tilting or the like in the package.

As an option, the second package side is pierced by the pusher for this purpose. This can be Implemented in a relatively economical way. However, a higher process reliability is achieved in a version according to which the second package side is cut open in an automated way before the pusher Is moved into the package. Owing to the cutting open, the pusher can move into the package without resistance and through a defined opening and can furthermore optionally be designed with a broad end face because no point is required to penetrate the package, e.g. with an end face which accounts for at least 20% of the area of the second package side. As a result, the workpiece is reliably pushed out of the package. For round workpieces and/or to avoid lateral drift of the workplace, an end face of concave configuration is an appropriate choice. With such an end face, the workplace can be pushed forward centrally in front of the end face.

It has proven particularly advantageous if the first and the second package side are cut open simultaneously. As a result, the process is particularly quick and the required apparatus is compact. Moreover, forces of the cutting or sawing tool that act on the package can be balanced out.

Moreover, in one specific implementation of the method, it is envisaged that the cutting open of the first and/or the second package side Is performed by means of a cutting or sawing tool (in particular a mechanical cutting or sawing tool). Although a cut with a water jet is also possible and, in particular, can be performed without wear, such a cut may only be considered in the case of workpieces which are allowed to be wet in the subsequent work steps. The cutting or sawing tool is preferably aligned vertically. Accordingly, the first package side should be aligned vertically while being cut open.

According to a preferred implementation, the cutting or sawing tool is driven in rotation. Such rotating cutting or sawing tools have a particularly long life and perform precise cuts. Alternatively, it is also possible to consider implementations in which the cutting or sawing tool performs a linear cutting movement, e.g. by means of a reciprocating movement (similarly to a Jigsaw) or a revolving movement (similar to a band saw). With these, it is also possible to produce non-linear cuts.

Cuts are particularly simple and space-saving if the package is guided past the cutting or sawing tool in an automated manner as the first and/or the second package side are/is cut open. In this case, the package is preferably guided past by pushing it along a movement path. The package Is thus supported on an underlying surface.

One particular version of the cutting-open process envisages that the cutting open of the first package side comprises complete separation of the first package side, and/or cutting open the second package side comprises complete separation of the second package side. It is thereby possible with little outlay to produce an opening of maximum size for sliding out or for moving in the pusher. Waste openings which are configured to ensure that parts of the package which have been separated or cut off fa downwards through a waste opening are preferably formed in the region in which the package is cut open. As a result, they no longer interfere with the processing of a further package.

Optionally, the package has a cuboidal outer covering, which forms the first and the second package side. Such packages can be produced at particularly low cost and can be aligned and cut open relatively easily. The package is preferably a cardboard box.

According to one version of the method, the workpiece slides out of the package together with a package shell in which the workpiece is arranged. A package she of this kind is particularly advantageous because the workpiece can thereby be held in a defined position within the package and cutting open can be performed at defined positions in such a way that the workpiece is not damaged. The package shell can be a blister tray. Furthermore, the package shell can be composed of plastic, cardboard or paperboard. It is to be preferred if the workpiece is aligned flat during the cutting open and sliding out. Accordingly, the package shell should also be aligned flat during the sliding-out process. As a result, the workpiece or the package shell cannot fall over and thereby be damaged.

An optional supplement to the method can consist in the workpiece being picked up mechanically by means of a workpiece holder after sliding out. In this way, the workplace can be transferred onwards by mechanical means. Such a workplace holder can have a gripper or a suction holder. The workpiece is preferably separated from the optional package shell as it is picked up by means of the workpiece holder. The package shell and the workpiece are preferably arranged vertically adjacent to one another before separation, and the upper of the two parts Is lifted away upwards. By weighing the part that has been lifted off upwards, for example, it is possible to ascertain whether this is the workpiece or the package shell.

The package shell can be allowed to fall downwards through a waste opening, for example, after separation from the workpiece. Accordingly, the processing surface is once again ready for a subsequent unpacking operation.

For workpieces which are arranged with an envelope in the package, with or without a package shell, automated removal of the envelope can be carried out after the workpiece has slid out of the package. Bags and wrapping films can be fixed by means of suction holders acting in opposition, for example, and are then tom open by increasing the distance between the suction holders. Alternatively and particularly in the case of almost all enveloped lenses or lens blanks, it is possible to implement the securing of the workpiece initially from the front and rear sides, e.g. by clamping, and then the performance of a circumferential cut at the circumference. Particularly in the case of the production of spectacle glass, such edge regions are removed in any case after surface machining for adaptation to a spectacle frame, and therefore even cutting marks in this edge region of the workpiece are uncritical. As soon as the circumferential cut has been carried out, the upper half of the envelope can be lifted off, then the workpiece can be fixed from above and, finally, it can be pulled out of the lower half of the envelope.

The method can furthermore comprise a step in which the package is aligned in an automated manner before the first and/or the second package side are/is cut open. Supply is thereby made simpler since the package does not have to be positioned precisely before being aligned.

In the case of dissimilar workpieces, it furthermore makes sense to read out information data on the workpiece from the package and associate it physically and/or logically with the workpiece removed in an automated manner. A physical association can be an appended datasheet, for example, which is added to a job tray, for example. The physical association can also be reduced to a physical Identification marker, e.g. likewise on the Job tray or on the component itself, this being by means of a barcode or QR code on the lens circumference or on the surface to be subsequently machined, for example. In this case, the actual information data on the identifiable workpiece can be stored in a database. A purely logical association Is accomplished, for example, if an automated system knows at all times which workpiece is situated where, by way of example by means of Identification numbers of job trays or visual monitoring.

The securing of the information data on the workpiece which is necessary for the association ideally takes place before the package is cut open to ensure that Information data are not lost due to the cutting process. The information data to be read out can be in the form of pure text, for example, but they are preferably indicated as a barcode, QR code or some other visual code or are stored on an RFID chip.

A high degree of automation can furthermore be achieved if the package is removed in an automated manner from what specialists in the field refer to as a job tray before being cut open. This enables the packages with the workpieces to be supplied to the unpacking process directly from automated stockholding facilities, even if the packages are of different sizes. The job trays have the advantage that they can interact without difficulties with automated transfer devices such as conveyor belts, especially also with different workpieces.

For further automated execution, it is expedient to deposit the workpiece in a job tray in an automated manner after it has slid out. On the one hand, simple onward transfer is thereby possible, in particular also Independently of the shape of the workpiece, and, on the other hand, information data for the further work steps can be associated in a simple manner with the workpieces.

Particularly in the case of lens processing and spectacle glass manufacture, deposition in such a way that a convex surface of the workpiece faces upwards is expedient. An orientation step, in which the workpiece is either deposited in job trays in a manner oriented in the same way as after sliding out or is rotated before being deposited, is expedient.

The method is particularly efficient if all the method steps between removal of the package from the job tray and deposition of the workpiece in the job tray or some other job tray are performed in an automated manner, this including, in particular, removal and deposition.

The invention furthermore relates to an unpacking apparatus for unpacking a workpiece, in particular an optical lens or an optical lens blank, from a package, preferably after a process such as that described above and below, which has a feed station for receiving a package in which a workpiece is arranged, a cutting-open station having a first cutting or sawing tool for the automated cutting open of a first package side of the package downstream of the feed station, and a slide-out station downstream of the cutting-open station, by means of which a relative movement can be produced between the package and the workpiece in an automated manner, by virtue of which the workpiece slides out of the package on the first package side.

The advantage of this unpacking apparatus is that automatic unpacking of a workpiece is accomplished with low unpacking costs and without manual sources of error.

The slide-out station should have a fixing device, by means of which the package can be fixed during the sliding-out process. By this means, the unpacking location is defined, and slipping of the package during sliding out is prevented, thus ensuring that the package is then always at the envisaged location. From there, the package can then simply be disposed of.

According to a more specific embodiment of the unpacking apparatus, the slide-out station has a pusher, which is configured to move into the package on a second package side situated opposite the cut-open first package side and to push the workpiece out of the package on the first package side. A pusher of this kind allows high process reliability. The pusher should preferably perform a sliding movement in the horizontal direction. Moreover, the direction of movement of the pusher is preferably aligned transversely to the cutting direction of the first cutting or sawing tool and/or the movement path.

In addition, it is possible to envisage the cutting-open station having a second cutting or sawing tool for automatically cutting open the second package side of the package downstream of the feed station. This enables the pusher to be moved into the package easily and in a reliable process. It is preferred here that the first and the second cutting or sawing tool are arranged parallel to one another. The advantage with this is that the package does not have to be rotated to enable it to be cut open on both sides. Moreover, it is to be preferred that the first and the second cutting or sawing tool are arranged opposite one another. This makes it possible to carry out the cutting open of the first and the second package side simultaneously. By fixing the distance between the first and the second cutting or sawing tool, it is furthermore possible to determine where the package is cut open.

A preferred embodiment consists in that a movement path for the package is formed between the first and the second cutting or sawing tool. The movement path thus offers the possibility of being able to move the package easily along the movement path, e.g. by means of a slide, pusher or the like, for cutting open. In this case, the movement path should be on a table. This ensures that there is a defined supporting surface for the package.

According to one specific embodiment, the first and/or the second cutting or sawing tool are/is arranged in a fixed location. This enables the mounting to be implemented in a space-saving and economical manner. Cutting or sawing tools which are mounted adjustably for the setting of a distance between the cutting or sawing tools should also be taken to be fixed in location.

As an option, the first and/or the second cutting or sawing tool can have a reciprocating cutting edge (similar to a jigsaw) or a revolving band (similar to a band saw). However, a particularly long life and precise, uniform cuts are achieved if the first and/or the second cutting or sawing tool is driven in rotation about a tool axis (similar to a circular saw or an angle grinder).

Moreover, there is the equipment option that (at least one) waste opening, through which cut-off parts of the package can fall downwards, can be formed in the region of or downstream of the first and/or the second cutting or sawing tool. Thus, the working surface is once again Immediately free for further unpacking operations.

Upstream of the cutting-open station, the unpacking apparatus preferably has a distance detection device, by means of which the distance between the first and the second package side is detected, wherein the position of the first and/or the second cutting or sawing tool correlates mechanically or in an automated way with the detected distance, preferably in such a way that the distance between the first and the second cutting or sawing tool is matched to the distance between the first and the second package side.

As an addition, the unpacking apparatus can have alignment elements, by means of which the package is aligned in an automated manner before the first and/or the second package side are/is cut open. As a result, the requirements on positioning before alignment are low, and therefore the apparatus can be Implemented at low cost.

The unpacking apparatus can furthermore have a transfer device for transferring the package from the feed station to the slide-out station. As a result, the position change of the package along the movement path takes place in an automated manner. A transfer device of this kind can have a gripper or a suction holder for fixing the package which can be moved between the feed station and the slide-out station. The transfer device preferably fixes the package on the circumference which does not include the first package side and, as a particular preference, on the side arranged at the top, in particular in such a way that at least the first, and optionally also the second, package side are freely accessible.

As an option, the fixing device of the slide-out station can be the same apparatus as that for moving the package along the movement path. For this purpose, the transfer device would only have to stay at the end of the movement path and fix the package until the sliding out of the workpiece is complete.

Downstream of the slide-out station, it is possible to arrange a workpiece holder, which is designed to pick up the workplace mechanically after it slides out of the package. From this moment, therefore, the workpiece can continue to be handled mechanically, free from the package. For this purpose, the workpiece holder can have a gripper or a suction holder. In addition, the workpiece holder can optionally be configured in such a way that it can be moved upwards to receive the workpiece by means of an opening at the bottom, in particular in the table.

There is furthermore the option of being able to arrange downstream of the slide-out station a separating device, by means of which part of the package can be removed from the workpiece. The separating device can have at least one gripper or suction holder. This can also include the workplace holder. For example, two workplace holders arranged one above the other and opposite one another can be provided, thus ensuring that there is always one of these which receives the workpiece while the other receives a package component, in particular a package shell. After removal of the package shell, one workplace holder can then transfer the workpiece to the other workpiece holder for further handling, or can itself bring the workpiece to a target location.

In this case, it is expedient if the separating device has at least one balance, by means of which components of the package and the workpiece are identified in an automated manner, in particular from their weight.

As an addition, the separating apparatus could have at least two waste bins, into which different materials of the package could be dumped separately. This is appropriate for recycling purposes. In this case, there Is the option of arranging a size reduction device, shredder or press upstream of at least one of the waste bins. As a result, the emptying cycles for the waste bins are long.

For further handling of the workpiece, an expedient development is one according to which the unpacking apparatus has a loading station which is configured to place the workpiece in a job tray downstream of the slide-out station. This can be supplemented by the unpacking apparatus having a conveying line, in particular a conveyor belt, for transferring the job tray. This enables it to be integrated directly into a production line. According to one specific version, the unpacking apparatus is configured to remove packages with workplaces on the input side from job trays which come from an automated store, for example. On the output side, the unpacked workplaces are then deposited in the or In some other empty job tray. During this process, the job trays should remain on the conveying line for the entire time. The movement path Is then as it were a section of a bypass for the workpieces relative to the conveying line. In this case, the movement path preferably runs at least substantially in the conveying direction of the conveying line.

In one specific embodiment of the invention, it is possible, in particular, to place packaged lens blanks from a job tray in an unoriented manner into an alignment unit, to cut off the first and the second package side, and then to push the lens blank together with the package shell upside down or in a normal position out of the package, and then to separate the lens blank and the package shell with the aid of a balance (e.g. a displacement measuring cell). By detecting the weight difference, the correct position of the lens blank for insertion in the or in some other job tray can furthermore be determined. In processing the lens, the desired position is usually such that the front curve of the blank faces upwards.

The invention furthermore relates to a processing apparatus having an unpacking apparatus of the type described above and below and a processing machine, wherein the unpacking apparatus is arranged upstream of the processing machine along an automated conveying line, and unpacked workpieces are transferred from the unpacking apparatus to the processing machine by means of the conveying line, wherein the processing machine is from the following group comprising milling machines, lathes, grinding machines, polishing machines, coating machines, cleaning machines, film wrapping machines, and block-mounting machines. The processing apparatus thereby makes possible automated processing, including unpacking the workpiece, and therefore there is high efficiency with reduced sources of error.

It is likewise part of the invention that all the method features also indicate optional functional configurations of the unpacking apparatus according to the invention. Conversely, the defined apparatus features can each optionally be used in implementing the method according to the invention.

Further features, details and advantages of the invention will become apparent from the wording of the claims and from the following description of illustrative embodiments with reference to the drawings. In the drawings:

Figure 1:
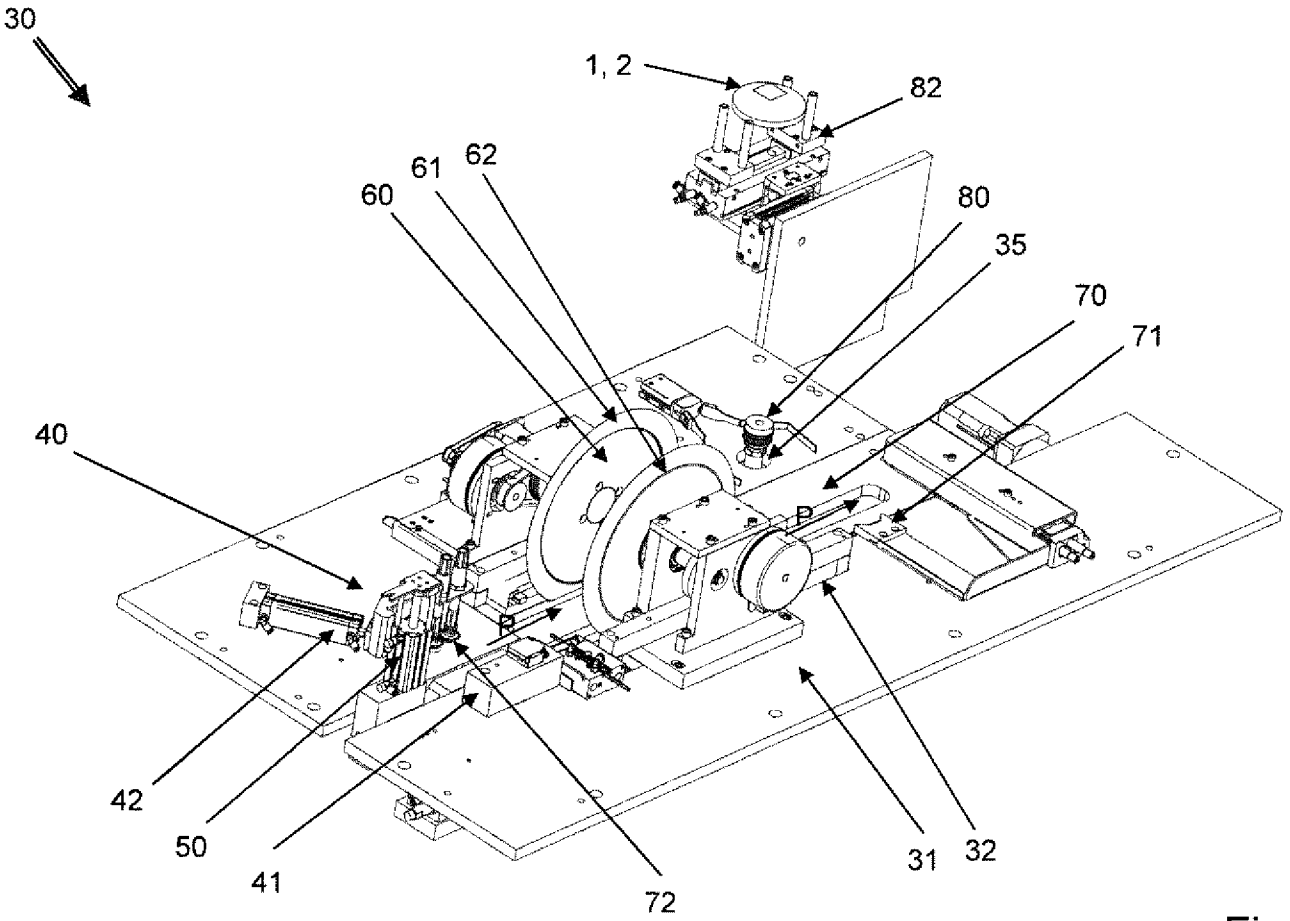
FIG. 1 shows a perspective view of selected subassemblies of an unpacking apparatus.
Figure 2:
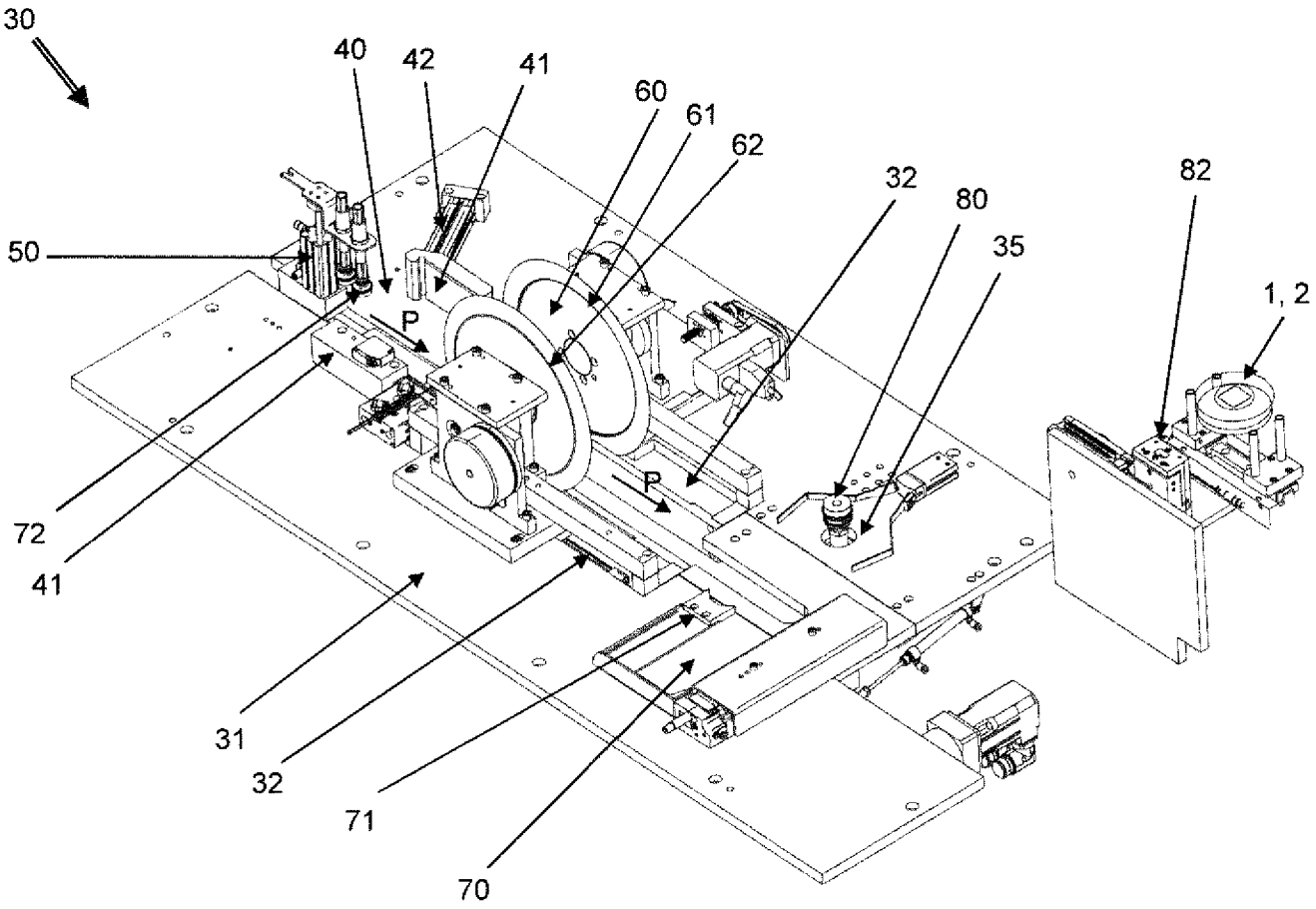
FIG. 2 shows a different perspective view of the selected subassemblies of an unpacking apparatus according to FIG. 1.
Figure 3:
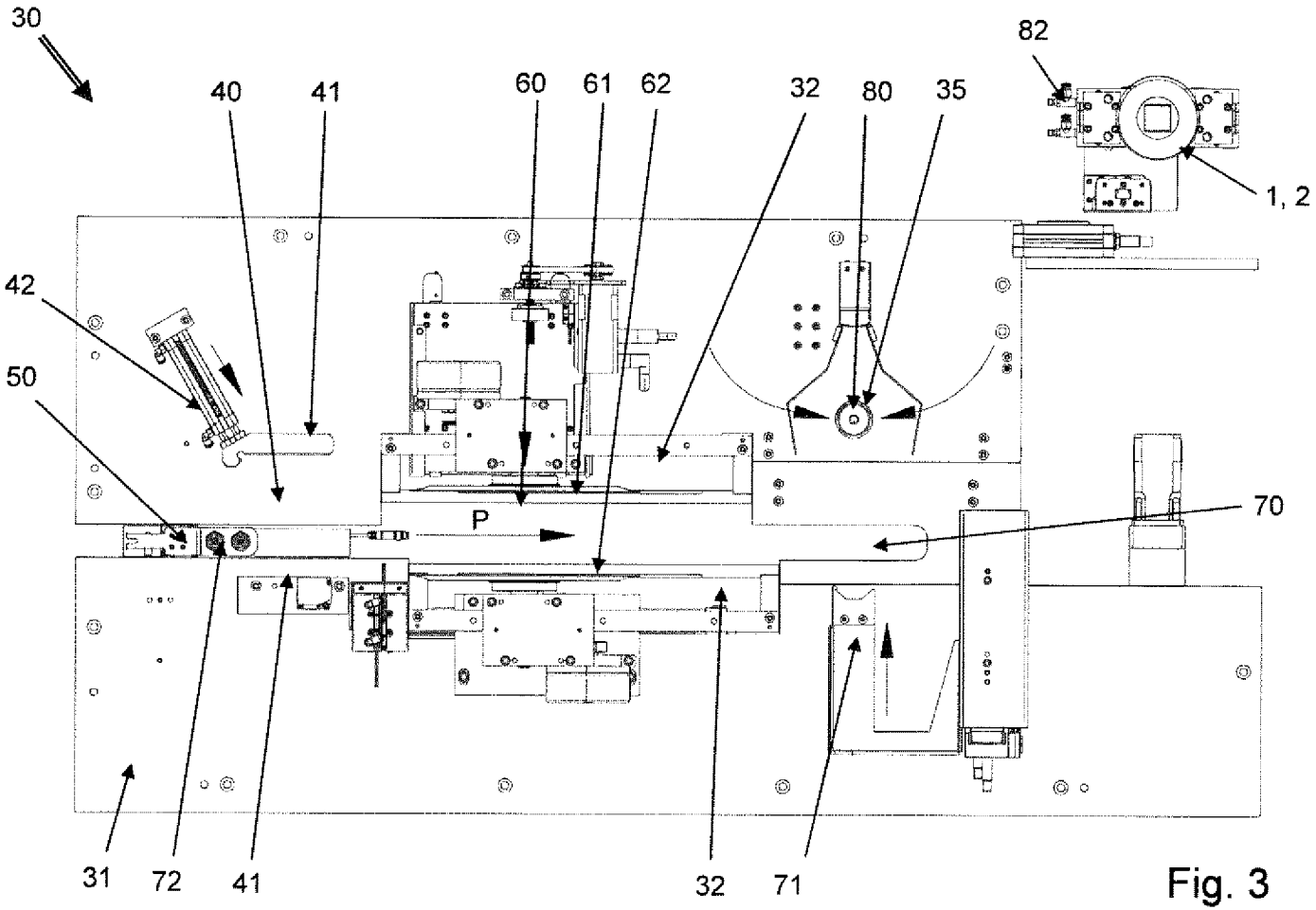
FIG. 3 shows a view of the selected subassemblies of an unpacking apparatus according to FIG. 1 from above.
Figure 4:
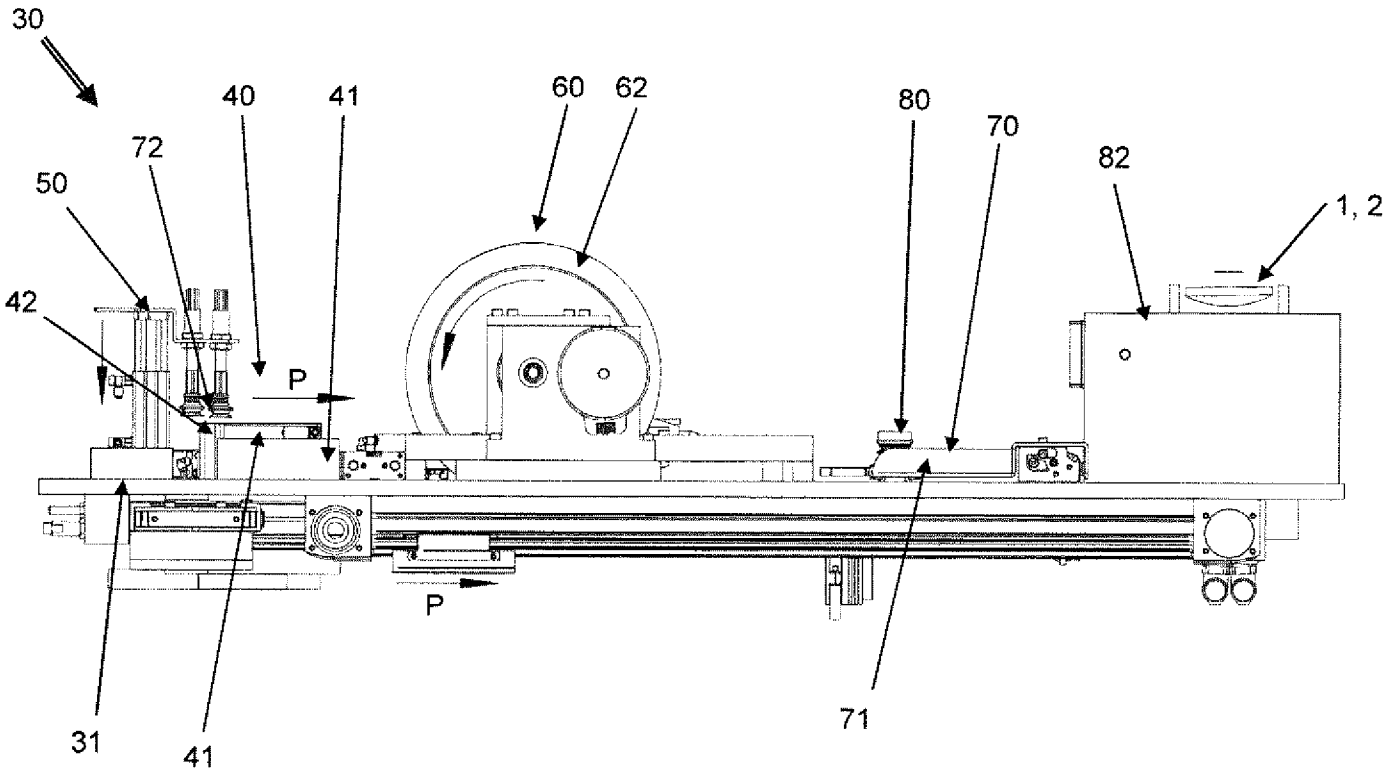
FIG. 4 shows a side view of the selected subassemblies of an unpacking apparatus according to FIG. 1.

FIG. 1 shows a selected subassembly of an unpacking apparatus 30 in a perspective view obliquely from above. The same subassembly is illustrated in FIGS. 2, 3 and 4 from a second perspective obliquely from above, a view from above and in a side view. The same reference signs therefore correspond and FIGS. 1, 2, 3 and 4 are described jointly below. Such a subassembly of an unpacking apparatus 30 can be contained in an unpacking apparatus 30 according to FIG. 5 in order to unpack workpieces 1 from packages 10 according to FIGS. 6 and 7.

The selected subassembly of an unpacking apparatus 30 according to FIGS. 1, 2, 3 and 4 shows an arrangement of various stations on a surface of a table 31, in particular with a flat table surface. A feed station 40 for receiving a package in which a workpiece is arranged is provided on the input side. Movable and fixed-location alignment elements 41, by means of which the package is aligned in an automated manner, are arranged here. The movable one of the alignment elements 41 is combined with a distance detection device 42, by means of which the distance between a first and a second package side of the package is detected. As soon as the package is namely clamped between the movable and the fixed alignment element 41 during alignment, the position of the linear motor by means of which the movable alignment element 41 is moved can be detected.

As soon as the package is aligned with the alignment elements 41, a transfer device 50 takes over the package in order to move it, in particular slide it, along a movement path P from the feed station 40. For this purpose, the transfer device 50 has a suction holder, which is placed on the package from above in order to fix the package and is driven slidably along a linear slot in the table 31.

A cutting-open station 60 is first of all arranged downstream of the feed station 40 along this movement path P. This has a first cutting or sawing tool 61 for cutting open a first package side of the package in an automated manner, and a second cutting or sawing tool 62 for cutting open an opposite second package side of the package in an automated manner. For this purpose, the first and the second cutting or sawing tool 61, 62 are arranged in a fixed location opposite and parallel to one another, in particular in such a way that the first and the second package side can be cut open simultaneously. The first and the second cutting or sawing tool 61, 62 are driven in rotation about respective tool axes, which are aligned coaxially in the present case. Irrespective of other technical features, this has the advantage of allowing the use of tools of identical construction, reducing stockholding for wearing parts and causing similar forces on the package, which can balance out.

By fixing the distance between the first and the second cutting or sawing tool 61, 62, it is possible to determine where the package 10 is cut open. In this case, the position of the first cutting or sawing tool 61 correlates in an automated manner with the distance, determined by the stop elements 41, between the first and the second package side. The distance set between the first and the second cutting or sawing tool 61, 62 is always somewhat smaller than the distance between the first and the second package side, e.g. 10% less.

In the present case, the movement path P runs between the first and the second cutting or sawing tool 61, 62, thereby enabling a package simply to be moved along the movement path P in order to be cut open. In the region of and downstream of the first and the second cutting or sawing tool 61, 62, it is possible to see in each case a waste opening 32, which is formed in the table 31 and through which the cut-off parts of the package can simply fall downwards.

The transfer device 50 can be moved along the movement path P between the feed station 40, past the cutting-open station 60, to a slide-out station 70. This slide-out station 70 downstream of the cutting-open station 60 serves to produce a relative movement between the package and the workpiece in an automated manner, by virtue of which the workpiece slides out of the package on the first package side previously cut open. The transfer device 50 simultaneously forms for the slide-out station 70 a fixing device 72, by means of which the package 10 is fixed during the sliding-out process. For this purpose, the transfer device 50 simply remains in the region of the slide-out station 70 until the sliding-out process is complete. The package can then be fed directly to a waste bin by means of the transfer device 50.

It can be seen that the slide-out station 70 has a pusher 71 with a concave end face, which is configured to move into the package on the second package side, the latter being situated opposite the cut-open first package side and likewise being cut open, and to push the workpiece out of the package on the first package side.

After the workpiece has been pushed out of the package transversely to the movement path P, with or without an optional package shell, the transfer device 50 can move backwards to the feed station 40 again in order to pick up a new package with a workpiece.

Provided downstream of the slide-out station 70 is an orientation tool in the form of a horizontally acting clamp, by means of which the workpiece is aligned again before being picked up mechanically. In the centre of this centering clamp there is a workpiece holder 80 having a suction holder, which is designed to pick up the workpiece mechanically after it slides out of the package. To pick up the workpiece, the workplace holder 80 moves upwards out of the table 31 through an opening 35 (at the bottom) in the table 31. A second workpiece holder (not illustrated) can be moved up to the workplace coaxially from above. If there is no package shell, the second workpiece holder may be sufficient on its own to carry the workpiece onwards to a target location. Whenever there is a package shell present, one of the two workpiece holders 80 will pick up the workpiece and the other will pick up the package shell. Identification of the respectively picked-up part enables the second workpiece holder either to move the workpiece to the target location or first of all to move the package shell to a waste bin on the way before it takes the workpiece from the first workpiece holder and moves it to the target location. The two workpiece holders 80 thereby form a separating device downstream of the slide-out station 70, by means of which parts of the package are removed from the workpiece.

This separating device can have one or two balances, by means of which parts of the package and the workpiece are Identified in an automated manner from the weight. It would also be possible by this means to identify different package materials, wherein the separating apparatus can have at least two waste bins for separate disposal thereof. Each waste bin can be assigned a size reduction device, a shredder or a press.

Figure 5:
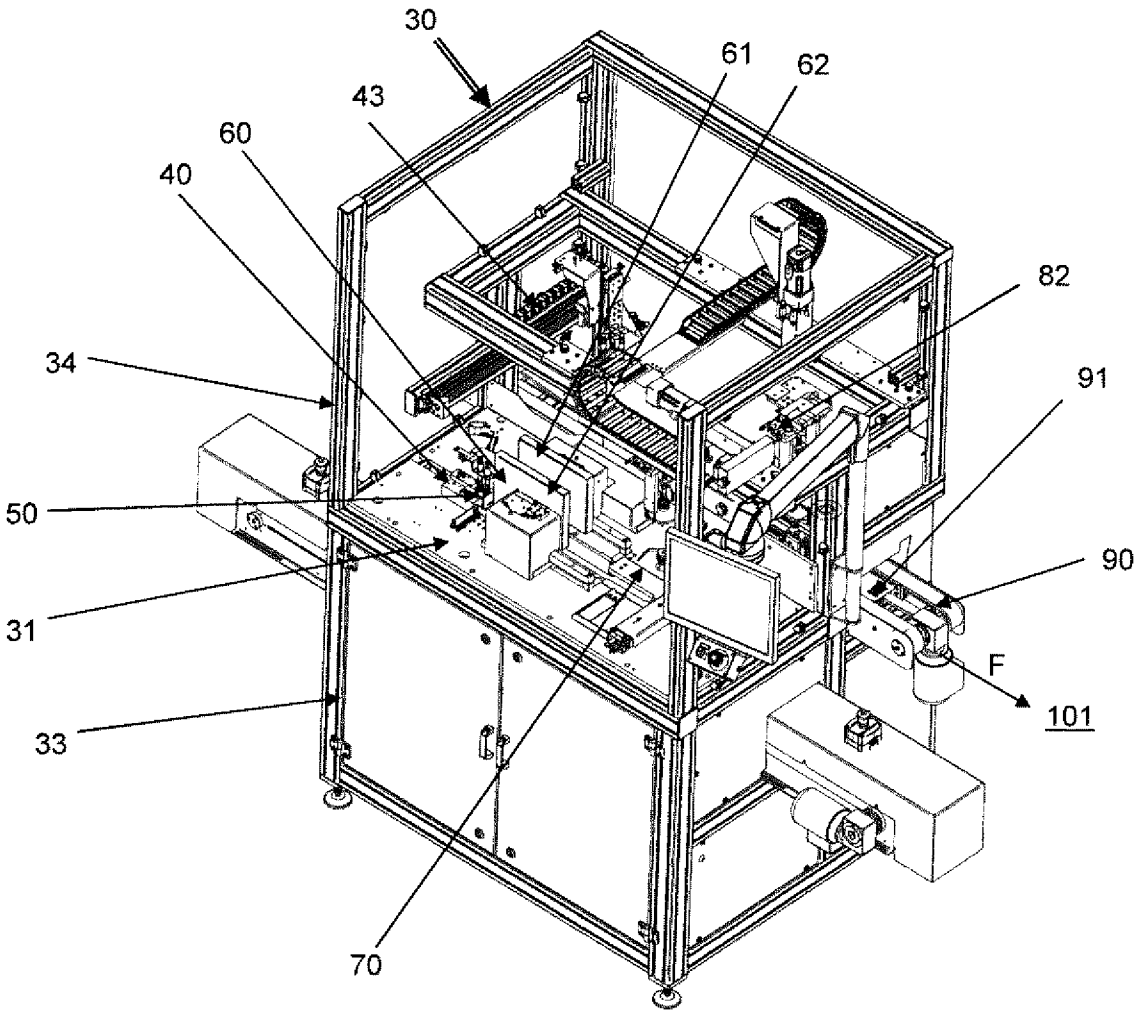
FIG. 5 shows a perspective view of an unpacking apparatus.

Finally, the unpacking apparatus 30 furthermore has a loading station 82, which is configured to place the workpiece downstream of the slide-out station 70 and the separating apparatus in a job tray of the kind that can be seen in FIG. 5.

In accordance with the unpacking apparatus 30 shown in FIG. 5, it can be seen that said apparatus has a conveying line 90, in particular a conveyor belt, for transferring job trays 91 in a conveying direction F. This runs parallel to and in the same direction as the movement path. It is thereby possible to remove packages with workpieces from job trays 91 coming from an automated store, for example, on the Input side by means of unloading device 43. On the output side, the unpacked workpieces are then deposited in the empty job trays 91. During this process, the job trays 91 remain on the conveying line 90 for the entire time. The movement path is as it were a section of a bypass for the workpieces 1 relative to the conveying line 90.

The table 31 can optionally have a stand 33. Moreover, the unpacking apparatus 30 can optionally have a cage 34. This can serve, in particular, to protect workers and to prevent unauthorized manual interference with the packages and/or workpieces.

The unpacking apparatus 30 according to FIG. 5 can be part of a processing apparatus, wherein the unpacking apparatus 30 is arranged upstream of a processing machine 101 (only indicated as a reference numeral) along an automated conveying line 90, and unpacked workpieces 1 are transferred from the unpacking apparatus 30 to the processing machine 101 by means of the conveying line 90. In particular, the processing machine 101 can be from the group comprising milling machines, lathes, grinding machines, polishing machines, coating machines, cleaning machines, film wrapping machines, and block-mounting machines. Particularly in the area of lens and spectacle glass manufacture, a block-mounting machine is taken to mean a machine by means of which a workpiece to be processed is fixed on a holding piece, in particular by material bonding, in an automated manner.

Figure 6:
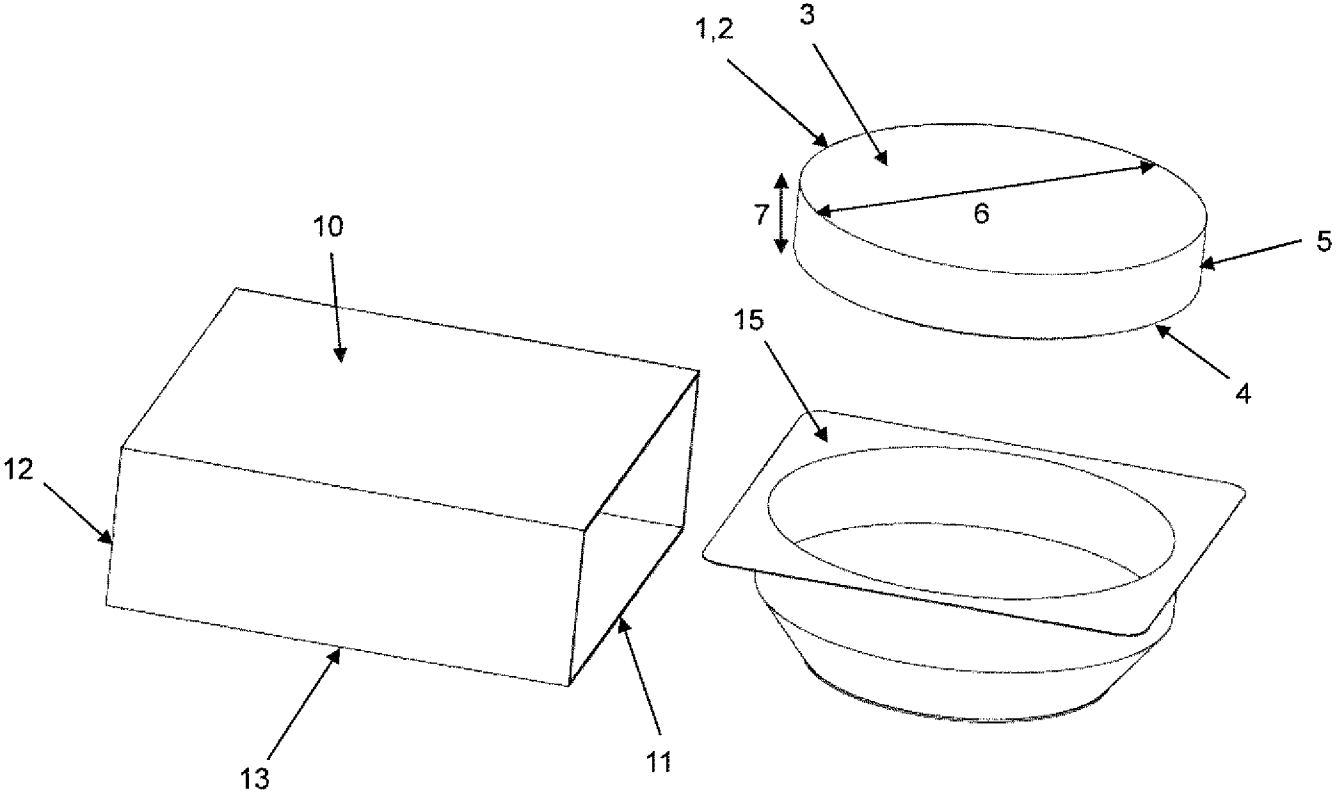
FIG. 6 shows an exploded illustration of a package illustrated in transparent form, of a removed package shell and of a lifted-out workpiece.
Figure 7:
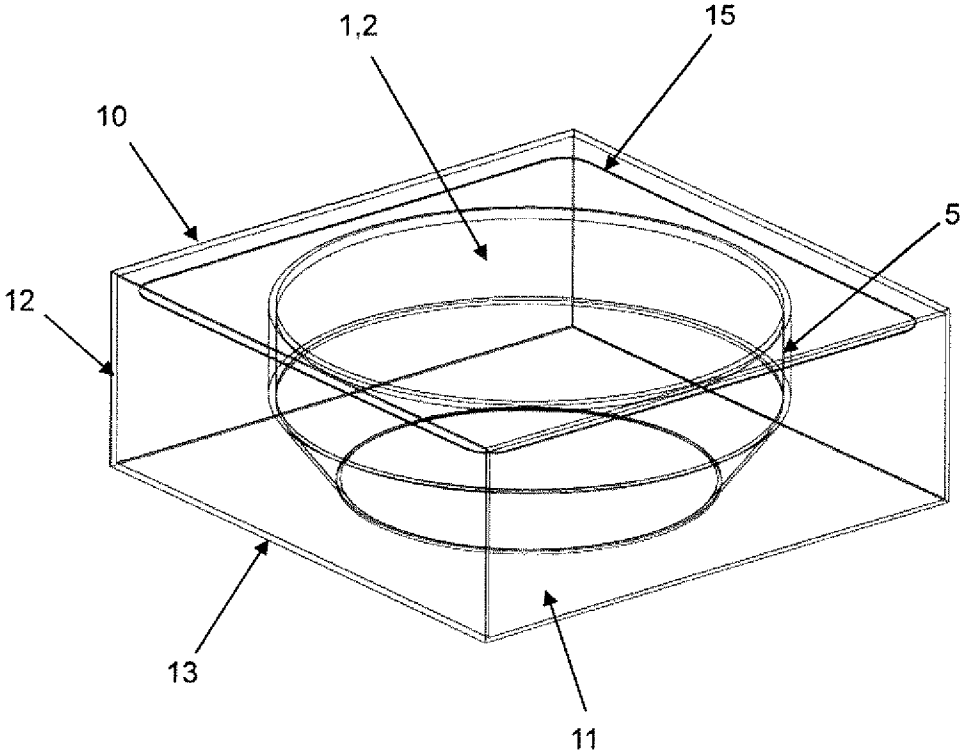
FIG. 7 shows a package illustrated in transparent form with an internally arranged package shell and a workpiece.

A package 10 (illustrated in transparent form) for holding a workpiece 1 can be seen in FIGS. 6 and 7. In the unpacked view in FIG. 6, it can be seen that the workplace 1 is an optical lens blank 2 having two opposite lens sides 3, 4, of which at least one can be of curved design. The optical lens blank 2 has a round lens circumference 5 with a lens diameter 6 of between 40 mm and 100 mm and Is composed of glass or transparent plastic. The lens thickness 7 is significantly less than the lens diameter 6. Optical lens blanks 2 of this kind are a typical starting material for processing to form spectacle glass, in particular a standard strength glass or an individual prescription glass.

The package 10 has a cuboidal outer covering 13, which forms the first and the second package side 11, 12, of which at least one is cut open, as described above, in order to remove the workpiece 1 from the package 10. Here, it Is always the case that two opposite sides of the cuboidal outer covering 13 form the first and the second package side 11, 12, in particular Irrespective of how the package 10 is aligned. Preferably, only alignments in which the package 10 is aligned flat are used. As a result, the workpiece 1 can be aligned flat as it Is cut open and slides out, and it does not tip over. However, it Is also conceivable to cut open the package 10 while upright, with the result that the two opposite sides that are closest to each other can form the first and the second package side 11, 12.

The package 10 is a cardboard box, in particular a folding box. In this case, it is irrelevant, in the cutting open of the first package side 11 in accordance with the invention, whether this is a simple package side or a lid. Instead of having to laboriously open the lid at a defined position, a first package side 11 is in all cases cut open or completely cut off on any side, thus enabling the workpiece 1 to be removed.

Information data on the workpiece can be applied or printed on the package 10, e.g. text, codes, such as barcodes and/or QR codes, or an RFID chip.

A package shell 15, which can be arranged within the package 10 together with the workpiece 1, can be seen as a further package component in FIG. 6. When the workpiece 1 is in the package shell 15, it is held at a distance from the first and the second package side 11, 12, as can be seen in FIG. 7. The package shell 15 is a blister tray made of plastic.

In the case of an unpacking method according to the invention or with an unpacking apparatus 30 according to the invention, a workpiece 1 packed in a manner corresponding or similar to that in FIG. 6 can now be unpacked in a simple and, above all, automated manner. Through automated adaptations, this can be accomplished even with alternating packages 10 of different sizes. According to the method, unpacking can take place, in particular, as follows:

As an option, the package 10 can be removed in an automated manner from a job tray before being cut open;

As an option, the package 10 can be aligned in an automated manner before the first and/or the second package side 11, 12 area/is cut open;

As an option, information data on the workplace 1 can be read out in an automated manner from the package 10 before it is cut open, and said data can subsequently be associated physically or logically with the workpiece 1 removed;

Automated simultaneous cutting open of the first and the second package side 11, 12 of the package 10 with a cutting or sawing tool 61, 62 driven in rotation, wherein, while the first and the second package side 11, 12 are being cut open, the package 10 is thereby guided past the cutting or sawing tool 61, 62 in an automated manner by the package 10 being pushed along a movement path P;

As an option, the cut-off parts can fall away downwards through a waste opening;

Automated sliding of the workpiece 1 with the package shell 15 out of the package 10 on the first package side 11 by pushing the workpiece 1 out on the first package side 11 by means of a pusher 71, which moves into the package 10 on the second package side 12 situated opposite the cut-off first package side 11;

Mechanically picking up the workpiece 1 after it has slid out by means of a workpiece holder 80 which has a gripper or a suction holder for this purpose;

As an option, the workpiece 1 can be separated from the package shell 15 as it is picked up by means of the workpiece holder 80;

As an option, the workpiece can be deposited in an automated manner in a job tray after sliding out;

In this case, all the method steps between removal of the package 10 from the job tray and deposition of the workpiece 1 in the or some other job tray 91 can optionally be carried out in an automated manner.

The invention is not restricted to one of the embodiments described above but can be modified in many different ways.

All the features and advantages that emerge from the claims, the description and the drawing, including design details, spatial arrangements and method steps, may be essential to the invention both per se and in a very wide variety of combinations.

LIST OF REFERENCE SIGNS

| | |
|---|---|
| 1 | workpiece |
| 2 | optical lens/optical lens blank |
| 3 | first lens side |
| 4 | second lens side |
| 5 | lens circumference |
| 6 | lens diameter |
| 7 | lens thickness |
| 10 | package |
| 11 | first package side |
| 12 | second package side |
| 13 | outer covering |
| 15 | package shell |
| 30 | unpacking apparatus |
| 31 | table |
| 32 | waste opening |
| 33 | stand |
| 34 | cage |
| 35 | opening at the bottom |
| 40 | feed station |
| 41 | alignment element |
| 42 | distance detection device |
| 43 | unloading device |
| 50 | transfer device |
| 60 | cutting-open station |
| 61 | first cutting or sawing tool |
| 62 | second cutting or sawing tool |
| 70 | slide-out station |
| 71 | pusher |
| 72 | fixing device |
| 80 | workpiece holder |
| 82 | loading station |
| 90 | conveying line |
| 91 | job tray |
| 101 | processing machine |
| F | conveying direction |
| P | movement path |

The invention claimed is:

1. Unpacking apparatus (30) for unpacking an optical lens or an optical lens blank (2) as a workpiece (1), from a package (10), having:

a feed station (40) for receiving a package (10) in which a workpiece (1) is arranged, a cutting-open station (60) having a first cutting or sawing tool (61) for the automated cutting open of a first package side (11) of the package (10) downstream of the feed station (40), and a slide-out station (70) downstream of the cutting-open station (60), by means of which a relative movement can be produced between the package (10) and the workpiece (1) in an automated manner, by virtue of which the workpiece (1) slides out of the package (10) on the first package side (11), wherein the first cutting or sawing tool (61) is arranged in a fixed location and the cutting-open station is configured so that the package (10) is guided past the first cutting or sawing tool (61) in the fixed location in an automated manner as the first package side (11) is cut open, and further wherein the slide-out station is configured so that the workpiece (1) slides out of the package (10) together with a package shell (15) in which the workpiece (1) is arranged.

2. Unpacking apparatus (30) according to claim 1, characterized in that the slide-out station (70) has a pusher (71), which is configured to move into the package (10) on a second package side (12) situated opposite the cut-open first package side (11) and to push the workpiece (1) out of the package (10) on the first package side (11).

3. Unpacking apparatus (30) according to claim 1, characterized in that the cutting-open station (60) has a second cutting or sawing tool (62) for the automated cutting open of the second package side (12) of the package (10) downstream of the feed station (40).

4. Unpacking apparatus (30) according to claim 1, characterized in that a movement path (P) for the package (10) is formed between the first and the second cutting or sawing tool (61, 62).

5. Unpacking apparatus (30) according to claim 3, characterized in that the second cutting or sawing tool (62) is arranged in a fixed location.

6. Unpacking apparatus (30) according to claim 1, characterized in that a waste opening (32), through which cut-off parts of the package (10) can fall downwards, is formed in the region of or downstream of the first and/or the second cutting or sawing tool (61, 62).

7. Unpacking apparatus (30) according to claim 1, characterized in that said apparatus has alignment elements (41), by means of which the package (10) is aligned in an automated manner before the first and/or the second package side (11, 12) are/is cut open.

8. Unpacking apparatus (30) according to claim 1, characterized in that said apparatus has a transfer device (50) for transferring the package (10) from the feed station (40) to the slide-out station (70).

9. Method for unpacking an optical lens or an optical lens blank (2) as a workpiece (1), from a package (10) using an unpacking apparatus according to claim 1, comprising the following steps:

a) automated cutting open of a first package side (11) of the package (10);

b) automated sliding of the workpiece (1) out of the package (10) on the first package side (11).

10. Method according to claim 9, characterized in that sliding out of the workpiece (1) is accomplished by pushing the workpiece (1) out on the first package side (11) by means of a pusher (71), which moves into the package (10) on a second package side (12) situated opposite the cut-open first package side (11).

11. Method according to claim 10, characterized in that the second package side (12) is cut open in an automated way before the pusher (71) is moved into the package (10).

12. Method according to claim 9, characterized in that the cutting open of the first package side (11) comprises complete separation of the first package side (11), and/or cutting open the second package side (12) comprises complete separation of the second package side (12).

13. Method according to claim 9, characterized in that the package (10) has a cuboidal outer covering (13), which forms the first and the second package side (11, 12).

14. Method according to claim 9, characterized in that the workpiece (1) slides out of the package (10) together with a package shell (15) in which the workpiece (1) is arranged.

15. Optical lens or optical lens blank processing apparatus having an unpacking apparatus (30) for unpacking an optical lens or an optical lens blank (2) as a workpiece (1), from a package (10), and a lens processing machine (101), the unpacking apparatus having:

a feed station (40) for receiving a package (10) in which a workpiece (1) is arranged, a cutting-open station (60) having a first cutting or sawing tool (61) for the automated cutting open of a first package side (11) of the package (10) downstream of the feed station (40), and a slide-out station (70) downstream of the cutting-open station (60), by means of which a relative movement can be produced between the package (10) and the workpiece (1) in an automated manner, by virtue of which the workpiece (1) slides out of the package (10) on the first package side (11), wherein the first cutting or sawing tool (61) is arranged in a fixed location and the cutting-open station is configured so that the package (10) is guided past the first cutting or sawing tool (61) in the fixed location in an automated manner as the first package side (11) is cut open, wherein the unpacking apparatus (30) is arranged upstream of the lens processing machine (101) along an automated conveying line (90), and unpacked workpieces (1) are transferred from the unpacking apparatus (30) to the lens processing machine (101) by means of the conveying line (90), wherein the lens processing machine (101) is from the following group:

milling machines;

lathes;

grinding machines;

polishing machines;

coating machines;

cleaning machines;

film wrapping machines; and block-mounting machines.

16. Unpacking apparatus (30) according to claim 1, characterized in that the first cutting or sawing tool (61) is driven in rotation or driven in a linear cutting movement by means of a reciprocating movement or a revolving movement.

17. Unpacking apparatus (30) according to claim 3, characterized in that the second cutting or sawing tool (62) is driven in rotation or driven in a linear cutting movement by means of a reciprocating movement or a revolving movement.

18. Unpacking apparatus (30) according to claim 3, characterized in that the cutting-open station is configured so that the package (10) is guided past the second cutting or sawing tool (62) in an automated manner as the second package side (12) is cut open.

19. Unpacking apparatus (30) according to claim 1, characterized in that the cutting-open station is configured so that the package (10) is guided past the first cutting or sawing tool (61) by pushing it along a movement path.

20. Unpacking apparatus (30) according to claim 18, characterized in that the cutting-open station is configured so that the package (10) is guided past the second cutting or sawing tool (62) by pushing it along a movement path.

21. Unpacking apparatus (30) according to claim 1, characterized in that the package (10) is a cardboard box.

22. Unpacking apparatus (30) according to claim 1, characterized in that the package shell (15) is a blister tray.

23. Unpacking apparatus (30) for unpacking an optical lens or optical lens blank as a workpiece (1), from a package (10), having:

a feed station (40) for receiving a package (10) in which a workpiece (1) is arranged, a cutting-open station (60) having a first cutting or sawing tool (61) for the automated cutting open of a first package side (11) of the package (10) downstream of the feed station (40), and a slide-out station (70) downstream of the cutting-open station (60), by means of which a relative movement can be produced between the package (10) and the workpiece (1) in an automated manner, by virtue of which the workpiece (1) slides out of the package (10) on the first package side (11), wherein the first cutting or sawing tool (61) is arranged in a fixed location and the cutting-open station is configured so that the package (10) is guided past the first cutting or sawing tool (61) in the fixed location in an automated manner as the first package side (11) is cut open, characterized in that the unpacking apparatus (30) has a distance detection device upstream of the cutting-open station (60), by means of which the distance between the first and a second package side (11, 12) is detected, wherein the position of the first and/or the second cutting or sawing tool (61, 62) correlates mechanically or in an automated way with the detected distance.

24. Unpacking apparatus (30) according to claim 1, characterized in that the unpacking apparatus (30) has a reader that reads out information data on the workpiece (1) in an automated manner from the package (10) before it is cut open, and said data are subsequently associated physically or logically with the removed workpiece (1).

* * * * *